US011572704B2

(12) United States Patent
Hecht

(10) Patent No.: US 11,572,704 B2
(45) Date of Patent: Feb. 7, 2023

(54) GAZEBO OR TENT

(71) Applicant: Gerald Hecht, Altheim (DE)

(72) Inventor: Gerald Hecht, Altheim (DE)

( * ) Notice: Subject to any disclaimer, the term of this patent is extended or adjusted under 35 U.S.C. 154(b) by 0 days.

(21) Appl. No.: 16/600,039

(22) Filed: Oct. 11, 2019

(65) Prior Publication Data

US 2020/0115919 A1 Apr. 16, 2020

(30) Foreign Application Priority Data

Oct. 12, 2018 (DE) ..... 10 2018 125 246.3
Oct. 12, 2018 (DE) ..... 20 2018 105 847.9

(51) Int. Cl.

*E04H 15/44* (2006.01)
*E04H 15/32* (2006.01)
*E04H 15/54* (2006.01)
*E04H 15/64* (2006.01)

(52) U.S. Cl.

CPC ..... *E04H 15/44* (2013.01); *E04H 15/322* (2013.01); *E04H 15/54* (2013.01); *E04H 15/64* (2013.01)

(58) Field of Classification Search

CPC ..... E04H 15/44; E04H 15/58; E04H 15/36
See application file for complete search history.

(56) References Cited

U.S. PATENT DOCUMENTS 196,171 A 10/1877 Warner
470,907 A 3/1892 Bradford
3,058,480 A * 10/1962 Blanchard ..... E04H 15/42 135/97
3,128,781 A * 4/1964 Kirkham ..... E04H 15/44 135/121
3,699,986 A * 10/1972 Kirkham ..... E04H 15/30 135/97
3,874,396 A * 4/1975 Kirkham ..... E04H 15/18 135/97
3,943,952 A * 3/1976 Marquart ..... E04H 15/14 135/93
5,299,590 A * 4/1994 Deibert ..... E04H 15/58 135/125
7,044,145 B2 5/2006 Bouchard
(Continued)

FOREIGN PATENT DOCUMENTS

DE 102016118739 A1 4/2018
EP 0753634 A1 1/1997
(Continued)

*Primary Examiner* — Noah Chandler Hawk
(74) *Attorney, Agent, or Firm* — Muncy, Geissler, Olds & Lowe, P.C.

(57) ABSTRACT

A gazebo with a two-dimensional cover and a rod assembly, which is connected to the cover and holds the cover in a three-dimensional shape. The rod assembly is formed of a main rod assembly and a secondary rod assembly, wherein the main rod assembly has one or more resilient rods, which connect end portions of two opposing gussets of the cover. The secondary rod assembly has one or more resilient rods to connect in each case center regions of the edge between two adjacent gussets of the cover with each other. At least one tensioning element to increase at least the spacing between the ends of a rod of the rod assembly to hold the gazebo in its three-dimensional shape. The gazebo has no center rod which supports the gazebo from the ground and which in particular provides no variation in spacing.

19 Claims, 4 Drawing Sheets

(56) References Cited

U.S. PATENT DOCUMENTS

| | | | | |
|---|---|---|---|---|
| 7,607,445 | B2 | 10/2009 | Von Dewitz et al. | |
| D605,308 | S * | 12/2009 | Combs | D21/837 |
| 7,673,642 | B1 * | 3/2010 | Shires | E04H 15/36 135/136 |
| 8,087,423 | B2 * | 1/2012 | Knipschild | E04H 15/40 135/125 |
| 8,567,423 | B1 * | 10/2013 | Combs, Jr. | E04H 15/06 135/120.3 |
| 9,593,507 | B1 * | 3/2017 | Aicher, Jr. | E04H 15/30 |
| 10,227,792 | B2 * | 3/2019 | Choi | E04H 15/44 |
| 10,378,233 | B2 * | 8/2019 | Shirley-Smith | B63B 34/00 |
| 2006/0054285 | A1 | 3/2006 | Louis | |
| 2007/0151588 | A1 | 7/2007 | Yul et al. | |
| 2012/0318316 | A1 | 12/2012 | Choi et al. | |
| 2017/0151588 | A1 | 6/2017 | Kim | |
| 2017/0191285 | A1 * | 7/2017 | Huang | E04H 15/48 |

FOREIGN PATENT DOCUMENTS

| | | | |
|---|---|---|---|
| EP | 1302120 | A2 | 4/2003 |
| EP | 1546494 | A1 | 6/2005 |
| EP | 1878858 | A1 | 1/2008 |
| WO | WO2017063009 | A1 | 4/2017 |
| WO | WO2017201555 | A1 | 11/2017 |

* cited by examiner

GAZEBO OR TENT

This nonprovisional application claims priority under 35 U.S.C. § 119(a) to German Patent Application No. 10 2018 125 246.3, which was filed in Germany on Oct. 12, 2018, and to German Patent Application No. 20 2018 105 847.9, which was filed in Germany on Oct. 12, 2018 and which are both herein incorporated by reference

BACKGROUND OF THE INVENTION

Field of the Invention

The present invention relates to a gazebo or a tent.

Description of the Background Art

From the European patent EP 1 546 494 B1 (which corresponds to U.S. Pat. No. 7,044,145) and the European patent EP 1 302 120 B1, umbrella-like tents are known, which are provided with a single center stand. The single ground-supporting stand has a sliding sleeve, which allows for the umbrella-like tent to be opened or collapsed when said sleeve is moved along the center stand. It is necessary for the mechanics of the center stand to be very strong in order to ensure that the tent stands securely.

A corresponding umbrella-like tent with a single decentralized support is known from US patent application US 2006/0054285 A1. This has the same disadvantages concerning the stability required of one single support.

From the International patent application WO 2017/201555 A1, an inflatable tent is known, the bottom floor and the supporting frame of which can be erected or reinforced by inflating, so that these are suitable for carrying the tent skin. This tent is easy to assemble, but of limited stability.

Furthermore, International patent application WO 2017/063009 A1 discloses a very stable tunnel tent, whose semi-circular glass fiber rods securely support the tent structure as soon as additional special anchoring elements are used for anchoring. In this case it is possible to remove the removable tent floor without the tunnel tent collapsing. This tunnel tent does not allow a user in particular to move around upright in the tent, and in particular to walk into or out of this tent.

Furthermore, from the German patent application DE 10 2016 118 739 A1 and the European patent application EP 1 878 858 A1 (which corresponds to U.S. Pat. No. 7,607,445) or EP 0 753 634 A1, tents are known whose rods extend in an arch crossing from one base point to another base point and carry the tent roof either resting on or hanging from the frame. In this case, the rods of the frame are each formed identically, wherein in one example they have additional end supports in the end region to stabilize the corners of the tent. In another example, the rods of the frame are provided with cords for tensioning the frame on which the tent cover is suspended inside the frame. The feet of the frame are braced against each other via anchor elements and tension lines running along the ground. In the third example, the frame is composed of a plurality of segments, which are guided together by a rope and are connected to form the frame. These tents, though quite stable, do not offer the option of walking into the tent or walking in it in an upright position.

The US patent application US 2012/318316A1 discloses a foldable tent. It has a tent canopy secured to a frame. At the highest point of the frame is a center hinge assembly which receives the rods of the frame in a pivoting manner. The rods are of different lengths, most extend to the ground, others do not and form a rain fly. The tent canopy completely envelops the tent interior which includes a floor, side walls and rain flies. This tent proves to be very burdensome during assembly and disassembly, especially with regard to the time required.

The US patent application US 2017/0151588A1 discloses a collapsible tent with rods of equal length extending from a center hub to the ground to form the feet, and a tent skin. In addition to the rods, a stretching mechanism is provided, such as an umbrella opening mechanism, which has a spring disposed on a center rod which connects to the center hub extending downwardly in the direction of the ground, which by way of the spring force presses spreaders along the center rod thereby causing a spreading apart of the rods of the tent. In addition, this tent has a solar module connected to the center hub for supplying power to the tent occupants. This tent proves to be very elaborate and vulnerable in its structure. Also, due to the arrangement of the center rod and the mechanism attached thereto it does not allow for the possibility of walking into the tent in an upright manner or moving inside the tent in an upright manner.

SUMMARY OF THE INVENTION

It is therefore an object of the present invention to provide an improved tent or gazebo as compared to the prior art, which improves utilization in particular with regard to walking upright, and which is sufficiently stable.

The gazebo or the tent according to the invention is provided with a two-dimensional cover and a rod assembly which is connected to the cover and is suitable and intended to hold the cover in a three-dimensional shape. In this case, the rod assembly is formed of a main rod assembly and a secondary rod assembly, wherein the main rod assembly has one or more resilient rods, which are suitable and intended in each case to connect the end portions of two opposing gussets of the cover and to form supporting feet for the gazebo or the tent. In addition, the secondary rod assembly has one or more resilient rods, which are suitable and intended in each case to connect middle regions of the edge between two adjacent gussets of the cover with each other. In addition, according to the invention at least one tensioning element is provided, which is suitable and intended to increase at least the spacing between the ends of a rod of the rod assembly and thus the spacing between the regions of the cover that are connected to the ends of the rods, whereby the cover of the tent or the gazebo is tensioned and its protective function is achieved.

The gazebo according to the invention or the tent according to the invention is characterized as a very stable and securely standing tent or securely standing gazebo precisely by the rods of the main rod assembly, which form the feet of the tent or the gazebo, with its continuous resilient rods.

The rods of the secondary rod assembly, which are independent of the rods of the main rod assembly and end in each middle region of the edge between two adjacent gussets of the cover, which are associated with the feet or the ends of the main rods of the tent or the gazebo, make it possible to very conveniently access the securely-standing tent or the securely-standing gazebo, allowing for entering the tent or the gazebo, or stepping out of these, in an upright manner.

Precisely by providing one or more inventive tensioning elements, which are suitable and intended to increase at least the spacing between the ends of a rod of the rod assembly and thus the spacing between the areas connected to the ends of the rod, a very convenient and secure handling of the tent or the gazebo is provided.

Preferably, it is possible to design the gazebo or the tent in such a way that no center rod is provided. This makes it possible to create a securely-standing tent or a securely-standing gazebo, which are easy to assemble and due to the chosen type of construction are very delicate and thus easy to set up. In this case, the gazebo or the tent preferably does not have any center rod which supports the gazebo or the tent from the ground and/or which does not provide variation in the spacing for tensioning the cover. This makes it possible in particular to create a securely-standing tent or a securely-standing gazebo, which are easy to set up and which due to the type of construction can be very delicate and thus easily assembled.

In addition, it has proven particularly useful to design at least one rod of the main rod assembly and/or the secondary rod assembly of the gazebo or the tent in several sections, wherein the rod sections are hinged together in a hinge region. This makes it possible to collapse the rods, thereby making the tent more compact when folded and easier to transport, which improves the handling of the tent or gazebo. All the more so if in particular a plurality of parts of several rods are hingedly connected in a common hinge region. As a result, on account of the articulated design, the rods can be folded together uniformly in an area of the tent or the gazebo which forms the hinge region, thereby improving handling, in particular transport. This is all the more so if the common hinge region is arranged centrally in the area of the cover or in the middle of the rods of the main rod assembly and/or the secondary rod assembly.

In addition, it has also been proven to further develop the gazebo or the tent such that at least one additional rod is provided for the main rod assembly and/or for the secondary rod assembly, which extends as part of the main rod assembly from an end portion of a gusset and/or as part of the secondary rod assembly from a center region to a common hinge region and is articulated there with other rods. This makes it possible to create a very stable structure of the gazebo or tent with a limited use of materials.

In a particularly preferred design of the invention, the articulated connection between rods or rod sections is formed by means of straps, wires, ropes, springs, rubber-elastic connecting elements and/or swivel joints. Especially due to the preferred choice of the articulated connection by means of straps, wires, ropes, springs, rubber-elastic connecting elements, a very robust, technically simple and reliable articulated connection is created, which functions reliably even under difficult external conditions, permanently ensuring ease of use of the gazebo or tent.

Preferably, a two-dimensional element is provided in the hinge region, which connects a plurality of straps, wires, ropes, springs, and/or rubber-elastic connecting elements of the articulated connection in the hinge region and compensates for the introduced stresses. This two-dimensional element in the hinge region distributes the stresses from the connected rods evenly among a plurality of, in particular, all rods. As a result, the structure of the rod assembly can be made particularly compact and collapsible. This significantly improves the handling of the gazebo or tent.

Moreover, it has been found particularly advantageous to provide the gazebo or the tent with at least one strap or one rope between different portions of a rod and/or a section of a rod and thus limit the different portions of a rod in terms of its spacing. By this limitation, it is possible to create a bias and thereby a bending in the rod and to thereby statically define the latter such that the structure of rod and strap or rope is maintained, even if this is subjected to an external force. In particular, this makes it possible to form the gazebo or the tent without a floor, which would connect and limit the feet of the rods of the main rod assembly. Preferably, all rods of the main rod assembly are provided with at least one rope or strap, which, as described, limits the different sections of the rod in terms of spacing. This arrangement makes it possible to render the gazebo or the tent particularly lightweight and thus very easy to handle, especially to transport.

It has proven particularly useful to provide multiple straps and/or ropes between different areas of a single rod and/or a single section of a rod, wherein these are suitable for jointly restricting the different sections in terms of their spacing. As a result, differentiated biases and thus differentiated bending radii of the rods can be generated to a desired degree, which has a positive effect on the usability of the gazebo or the tent, in particular with regard to head room.

In addition, it has proven to be especially useful in that at least one two-dimensional element is provided, which connects a plurality of straps or ropes which extend between different sections of a rod and/or a part of a rod and compensates for the introduced stresses. This takes place in particular in the region of the common hinge region. This two-dimensional element distributes the stresses from the connected ropes and/or straps evenly among a plurality of, in particular, all ropes and/or straps. As a result, the structure of the rod assembly with the ropes and/or straps can be designed to be particularly compact and collapsible. This significantly improves the handling of the gazebo or tent.

In a development of the gazebo or of the tent, at least one end of a strap or a rope is connected with a rod by a positive connection or by clamping, riveting or screwing. In this case, the positive connection is preferably created or released by hanging the rope or the strap into, or by removing these from, a corresponding recess. In this case, the rope or the strap preferably have a connecting element which in its outer contour corresponds with the recess and allows for a positive connection, by means of which tensile forces can be transmitted. In addition to the form-fitting connection, fastening by clamping, in particular by introducing into a wedge-shaped gap, has proven particularly useful in terms of handling due to the ease of handling. In order to create a particularly secure connection, a connection is preferably selected by means of screwing or riveting.

In this case, such a connection can be provided both between straps or ropes which realize an articulated connection, and between those that are suitable for generating a bias, and a rod or other ropes or straps or two-dimensional elements.

It has particularly been proven that for the gazebo or the tent, at least a two-dimensional web, in particular made of fabric or foil, for receiving a rod and a strap or a wire or a rope or a spring or a rubber-elastic connecting element is provided, wherein for the transmission of the tension, the web is provided between a rod and a received strap or wire or rope or spring or rubber-elastic connecting element. As a result, tensile forces can be transferred particularly reliably from the rod to a strap or a wire or a rope or a spring or a rubber-elastic connecting element. In particular with long webs, this arrangement allows for highly durable and lightweight and therefore very good handling of the further development of the gazebo or the tent. It has also been shown to be a preferred embodiment of the invention to form the two-dimensional webs with loops made from strip-shaped material and to provide in particular a plurality thereof. This embodiment proves to be particularly easy to manufacture.

It has proven particularly useful when the gazebo or the tent has a cover made of woven fabric and/or foil. In addition to pure plastic foil or pure woven fabric made from natural or synthetic fibers, composite materials made of a plurality of components, in particular both of woven fabric as well as of foil, have proven successful as foil-coated woven fabric. These composites prove to be particularly robust and easy to handle, which is particularly reflected in a low surface weight with a given stability.

The gazebo or the tent can have a cover, which is selected and arranged such that it is not formed so as to be stretchable in the region of a rod, whereas the cover is elastically stretchable in other directions. This is preferably realized by a suitable choice of the fiber direction of a cover constructed of fibers or by a suitable choice of fiber materials, including the structure of the fibers or the fiber dimensions (thickness, density or length). In this case, the cover is in particular designed such that it cannot be stretched along the rod, which is variable in length by means of at least one tensioning element, whereas the cover is formed to be elastically stretchable in another direction, in particular transversely to the variable-length rod. This embodiment of the cover allows for a very stable structure of the gazebo or tent.

It has proven to be particularly useful to make the rods of elastic material, in particular, a material made of metal, wood and/or a plastic, in particular made of fiber reinforced plastic. These materials can on the one hand ensure the necessary stability in connection with the shaping tension of the rod assembly, and on the other hand realize a rod assembly that is lightweight and thus easy to handle.

The rods of the gazebo or the tent can be connected with the cover in which the connection in the end region of the rods is created in the area of the end regions of the gussets or in the area of the center regions by means of gluing, by welding, by sewing, by releasable insertion into a pocket on the cover and/or by positive engagement. As a result, a secure connection of the cover is created, which allows for safe handling even under difficult circumstances. A connection by the releasable insertion into a pocket on the cover and/or by positive engagement also makes it possible to separate the cover from the rod assembly and to handle or transport it separately.

It has proven particularly useful to arrange the releasable connections at all end portions of the rods, which makes it possible to separate the cover from the rods of the main or secondary rod assembly and store, handle, etc. them independently of each other. Also, it has been proven to design the releasable connections, which are arranged exclusively on the end portions of the secondary rod assembly, in such a way that a pocket is provided in each case on the cover, into which the end portion of the rod of the secondary rod assembly is introduced and held in a guiding manner. This design provides a secure transmission of force from the secondary rod assembly to the cover especially via a reinforced edge of the cover and at the same time provides the possibility of release, which makes handling particularly advantageous. Preferred is a further development in which the ends of the rods of the main rod assembly are releasably yet securely connected with releasable rings as releasable connections from the cover. Preferably, these releasable rings are designed as spring rings. By this type of releasable connection, it is possible to improve the cover's protection against unwanted loosening from the main rod assembly, which forms the feet of the gazebo or tent according to the invention.

The gazebo or of the tent can have at least one tensioning element, which comprises a folding mechanism and/or a spreading element and/or a cable pull for producing the variation in spacing and/or a piston which is driven pneumatically or hydraulically or electrically or mechanically using a slip clutch. These mechanisms reliably enable easy handling of the tensioning element and thus easy erection of the gazebo or tent. In this case, the folding mechanism is preferably formed using a toggle lever mechanism, whereby the tensioning force is increased by using a lever and thereby handling is facilitated. In addition, it has also proven to provide the tensioning element with a piston, which is driven in particular pneumatically or hydraulically or electrically or mechanically using a slip clutch. Precisely when the piston with the slip clutch is driven by means of a lever, it is possible to expand the tensioning element with the piston by repeatedly actuating the lever in conjunction with the slip clutch, gradually and with low leverage and low lever travel, and to lengthen the rod connected to the tensioning element and place it under tension. Especially this design has proven to be particularly easy to handle.

Besides the possibility of spreading apart both the secondary rod assembly and the main rod assembly with the aid of tensioning elements, it has been found particularly advantageous to form the at least one tensioning element in such a way that it generates a variation in spacing between only the secondary rod assembly or only the main rod assembly. This structure proves to be more compact, less complicated and therefore less vulnerable and therefore particularly easy to handle.

The gazebo or the tent can have at least one tensioning element, which is designed such that it is arranged as a connecting rod, in particular of the secondary rod assembly, between two areas of one or two rods in such a way that by changing the length of the connecting rod, the spacing between the ends of the rod of the rod assembly connected with the connecting rod and thus the spacing between the areas of the cover connected with the ends of the rod can be adjusted. By providing a connecting rod which can be elongated with the aid of the tensioning element, it becomes possible to realize a compact structure and a readily manageable arrangement of the at least one tensioning element. This applies all the more, the more tensioning elements are provided in connection with such connecting rods.

To secure against unintentional opening and thus release of the tensioning element, a backup for at least one tensioning element, in particular all tensioning elements, is provided. By means of the one or more backups it is possible to prevent the incorrect operation of the tensioning element and thereby accidental folding of the gazebo or the tent, which has a positive effect on handling.

The gazebo or the tent, a release for each tensioning element is provided which allows for the release and joining of the connection between the rod and the tensioning element. By releasing the connection, it is possible to move the tensioning element separately from the rod and to collapse the rod assembly with the tensioning element, in particular by using articulated connections of the rods, and to transport or handle it particularly easy in a compact, folded state. To reassemble the gazebo or the tent, the tensioning element(s) is/are re-connected with the rod by the release in order to then move the rod or rods apart by means of the tensioning element, thereby increasing the spacing between the ends of the rod or the rods and opening up the cover of the tent or the gazebo.

It has proven particularly useful to provide the tensioning element with a guide element by means of which the released tensioning element is guided along the rod, by means of which the tensioning element or the connecting rod of the tensioning element is connected. This makes it easier to simplify the handling of and the connection of the tensioning element with the associated rod and to make this more reliable even under difficult conditions.

At least one tensioning element is configured such that it is provided with at least one side rod, which joins the connecting rod with a further rod, in particular, of the secondary rod assembly and is provided to transmit forces to the other rod and thus to the cover when changing the length of the connecting rod. This embodiment makes it is possible to vary the spacings between a series of rods and thereby to create an even more stable structure of the gazebo or tent according to the invention, which is characterized by a simple assembly or disassembly process that is easy to handle.

It has proven particularly useful to develop the gazebo or the tent such that at least one tensioning element is formed such that it is provided with at least two side rods, at least two of which are arranged in pairs on both sides of the connecting rod and both are connected to each other via the connecting rod in an articulated manner. The articulated connection is made in particular by means of a strap, for example made of fabric or high-tensile foil or leather, wherein the ends of the strap are fixedly connected to the ends of the side rods facing the connecting rod and wherein the strap is connected to the connecting rod, in particular via a fixing element. In this case, the fixing element can be, for example, a rivet, a screw connection or an adhesive connection. The connection to the connecting rod is preferably carried out such that the strap is firmly connected to the connecting rod and thereby a movement of the connecting rod is transmitted via the fixed strap to the side rods. This allows for the possibility of transmitting forces from the tensioning element via the connecting rod to the side rods and thus the cover. This makes it possible for the tensioning forces to be distributed to the cover by the tensioning element, thus making the opening up of the gazebo or tent according to the invention particularly reliable and easy.

Preferably, the strap surrounds the connecting rod such that the fixing element is mounted, in particular releasably mounted, on one side of the connecting rod and that the two ends of the side rods, which are firmly connected to the ends of the strap, come to rest on the opposite side of the connecting rod. This design of the articulated connection with the strap surrounding the connecting rod makes it possible for the tensioning forces, which are transmitted via a side rod, to lead to a rotational movement of the connecting rod, which is compensated by a counter-rotational movement by the tensioning forces, which are transmitted via the other side rod, which is made particularly possible by guiding the strap around the connecting rod and by fixing the strap to the connecting rod. A preferred, particularly stable state may be achieved by forming the assembly such that the longitudinal axes of the side rods intersect below the connecting rod. Due to a sufficiently wide strap width it is possible for lateral forces to be transmitted via the side rods to the end portion of the cover, which are connected to the ends of the rods, which in turn are connected to the side rods.

It has proven particularly useful to further develop the gazebo or the tent such that the number of rods of the secondary rod assembly is chosen to be not equal to that of the main rod assembly. Thus, the properties of the gazebo or the tent can be adjusted depending on the intended use, in particular by increasing the number of main rods and thus increasing the stability of the feet, whereas by increasing the number of secondary rods, access to the gazebo or the tent is improved, since the access opening to the gazebo or tent is arranged in the region of the ends of the secondary rods. A particularly preferred gazebo has, by way of example, three main rods and thus three feet, whereas it has four secondary rods. This gazebo has a compact and sufficiently stable structure, which provides sufficient protection against external influences, especially sun and wind or rain.

It has proven particularly successful that the cover of the gazebo or the tent is formed with at least one two-dimensional web, in particular made of fabric and/or foil for receiving one or more rods and/or one or more straps and/or one or more articulated connections of the rods. In this case, the two-dimensional web or webs are provided to transmit the tension from a received rod or a received strap to the cover. This way, tensioning forces can be particularly reliably transmitted from the cover to a rod, to a strap or to hinged connections of the rods. Providing the two-dimensional web(s) of the cover allows, in particular for long rods, for the reliable transmission of forces between the cover and the rods or the straps or ropes, and a good offset of these forces.

The two-dimensional webs can be formed using loops of strip-shaped material and in particular to provide a plurality thereof. This embodiment proves to be particularly easy to manufacture.

It has been found to be particularly useful to arrange at least one two-dimensional web in the region of a connecting line between the ends of two adjacent rods of the secondary rod assembly at the edge of the cover. Here, the two-dimensional web can also be formed as a loop. This option provides a particularly effective force compensation, which allows for a particularly safe and stable structure of the gazebo or the tent.

Alternatively, or additionally, it has been found particularly useful to provide rods of the main rod assembly with swivel joints, which include a stop for preventing hyperextension, which makes it possible to fold the main rods by means of the swivel joint, without unwanted overextension of the swivel joint being possible, which would negatively influence the stability of the main rods particularly when assembled. The folding facilitates handling and transport of the main rod assembly.

In particular, the length of the rod—whether it is a rod of the main and/or the secondary rod assembly—between the swivel joint and the common hinge region is selected according to the length between a rod of the secondary rod assembly and the common hinge region. This allows for a particularly simple and compact folding of the rod assembly, especially if all three lengths are selected to be about the same length by appropriately positioning the swivel joint.

Alternatively, or in addition to the swivel joints, it has also been proven to provide plug connections that allow for the separation of the rods into individual segments and thereby simplify transport and storage.

The gazebo or tent according to the invention can have at least one rod, in particular all rods, of the secondary rod assembly, which is/are formed more resistant to bending than at least one rod, in particular all rods, of the main rod assembly. This makes it possible for tensioning forces to be transmitted in a particularly effective manner from the tensioning element via the secondary rod assembly to the center regions of the edge between two adjacent gussets of the cover and that a tensile stress is transmitted via the edge of the cover to the end region of the gusset and thus to the ends of the main rod assembly. By means of the refined design of the rods with respect to the bending stiffness of the main and the secondary rod assemblies, it is possible on the one hand to ensure that the gazebo or tent stands very securely and secondly, to ensure that the process of setting up or taking down with the help of the tensioning element is particularly reliable.

At least one rod of the secondary rod assembly or the main rod assembly can be formed such that it is formed more rigid in the region of at least one of its ends than in its center region, in particular in the common hinge region. This makes it possible for the gazebo or the tent, in the erected state, to be more bent in the highest area than in the area of the feet or in the edge region of the cover. This results in a particularly functional, easily accessible and stable gazebo or tent.

Preferably, in the gazebo or the tent, the edge region of the cover is reinforced and in particular formed in a tension-proof manner. This makes it possible to transmit significant portions of the tensioning forces that are transmitted by means of the cover via the reinforced edge. Precisely because of this, the tensile or tensioning forces between the ends of the main rod assembly and those of the secondary rod assembly can be compensated or transmitted particularly well, which has a positive effect on the stability.

This proves to be especially helpful because the transmitted tensioning forces between the areas of the cover, which are connected to the end portions of the rods, are particularly high. By means of these reinforced edges it incidentally becomes possible to form the cover more lightweight, thereby improving the handling of the tent or the gazebo in particular during transport and assembly or disassembly.

Preferably, the pockets into which the ends of the rods of the main rod assembly are introduced and which are thus positioned relative to the cover are connected to a reinforced edge, in particular integrated therein, in such a way that a stable connection of the pockets with the edge is provided, which connection allows for the tent or gazebo to stand securely without additional anchoring.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
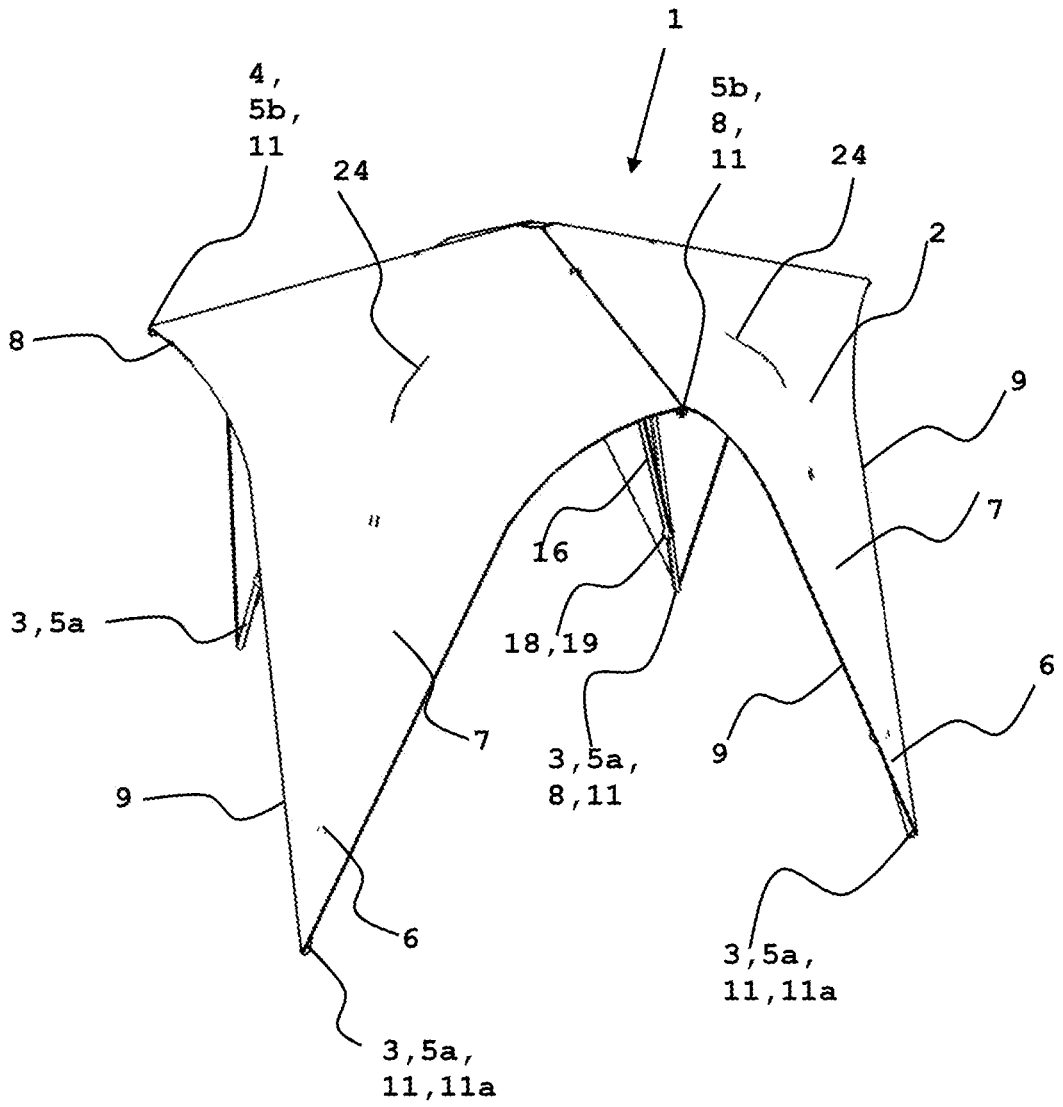
FIG. 1 shows a schematic representation of an exemplary gazebo according to the invention in a view obliquely from above.

FIG. 1 schematically shows an inventive, exemplary gazebo 1. The latter has a two-dimensional cover 2 and a rod assembly 3,4, which is connected to the cover 2 and is suitable and intended to hold the cover 2 in a three-dimensional shape.

The rod assembly 3,4 is formed of two parts, a main rod assembly 3 and a secondary rod assembly 4. In this case, the main rod assembly 3 has one or more resilient rods 5*a*, which are suitable and intended to connect in each case end portions 6 of two opposing gussets 7 of the cover 2 and thereby form supporting feet 11*a* for the gazebo 1.

In contrast, the secondary rod assembly 4 has one or more resilient rods 5*b*, which are suitable and intended to connect in each case center regions 8 of the edge 9 between two adjacent gussets 7 of the cover 2 with each other.

In order to keep the gazebo 1 stable in its assembled structure, the rod assembly 3,4 has at least one tensioning element 10, which is suitable and intended to increase at least the spacing between the ends 11 of a rod 5*a*,5*b* of the rod assembly 3,4 and thus the spacing between the areas of the cover 2 connected to the ends 11 of the rod 5*a*,5*b*. By this increase in the spacing, which is limited by the dimensions of the cover 2, resistive forces arise between the resilient rods 5*a*,5*b* stretched by the tensioning element 10 and the edge 9 of the cover 2 connected to the ends 11 of the rods 5*a*,5*b*.

Figure 3:
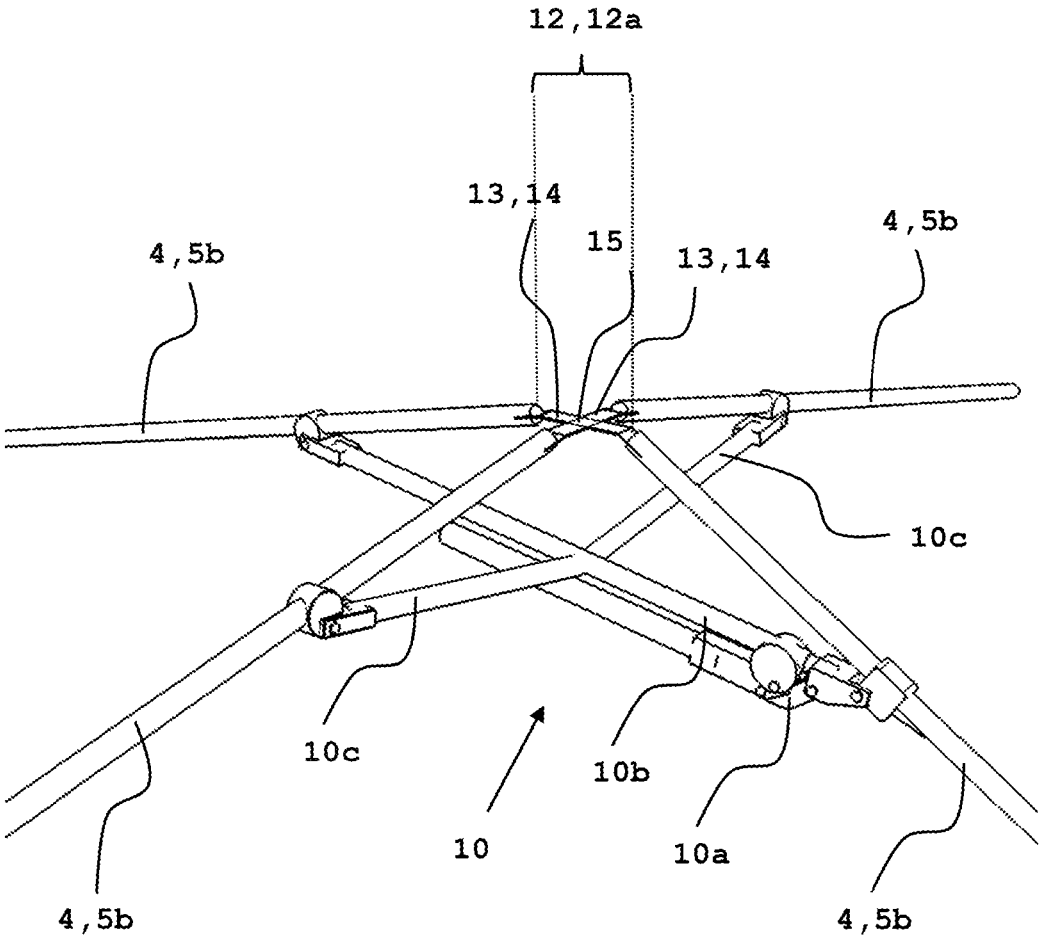
FIG. 3 shows a schematic representation of a tensioning element of the gazebo of FIG. 1.

The described tensioning element 10 is shown by way of example in more detail in FIG. 3.

These resistive forces are supplemented by forces generated by straps 16. The straps 16 are provided between different sections of a rod 5*a* or parts of a rod 5*a* and are suitable to limit the spacing between the different sections, whereby the further counterforce for generating the overall stability of the gazebo 1 is substantially determined. By balancing these forces, it is possible to achieve a statically stable state, which makes it possible on the one hand to dispense with a center rod and on the other hand to also dispense with elaborate ground anchors. Also, for purposes of limiting the spacing, the straps 16 can produce differentiated biases and thus differentiated bending radii of the rods 5*a* to a desired degree, which has a positive effect on the usability of the gazebo 1 in particular with regard to head room.

In this case, for limiting the spacing, the ends 18 of the straps 16 are connected to a rod 5*a* by a positive connection 19. In this case, this positive connection 19 is established or released by hanging the strap 16 in a corresponding recess or by removing it from the recess. In this case, the strap 16 has a connecting element for limiting the spacing, which in its outer contour corresponds with the recess and allows for a positive connection 19, by means of which tensile forces can be transmitted.

The gazebo 1 has four supporting feet 11*a*, which are formed by the ends 11 of the rods 5*a* of the main rod assembly 3. These are connected to the end portion 6 in each case of a gusset 7 of the cover 2, such that in the connected state, the end portions 6 are firmly connected to the ends 11 of the rods 5*a*, wherein this connection is releasably formed. This connection is realized in that the edge 9 of the cover 2 is reinforced and has pockets in the end portions 6 for receiving the ends 11 of the rods 5*a* of the main rod assembly 3. These reinforced pockets as part of the reinforced edge 9 provide a very robust cover 2 structure and at the same time a good transmission of force between the rods 5*a* of the main rod assembly 3 and the cover 2 of the gazebo 1. In this case, the pockets in the center regions 8 of the edge of the cover 2 between two gussets 7 are associated with the secondary rod assembly 4, whereas the ends of the rods 5*a* of the main rod assembly 3 are releasably connected to the cover 2 by means of spring rings in the area of the gusset 7. This makes it possible to prevent the gussets 7 from loosening from the main rod assembly 3 when folding the gazebo or tent, thereby improving handling.

According to the invention, only ends 11 of the main rod assembly 3 form supporting feet 11*a*. In the inventive, constructed gazebo 1, the rods 5*b* of the secondary rod assembly 4 end not as feet on the ground, but in the air. The resilient rods 5*b* of the secondary rod assembly 4 in each case connect center regions 8 of the edge 9, which are arranged between two adjacent gussets 7 of the cover 2 and thus between adjacent feet 11*a*. The ends 11 of the rods 5*b* are firmly but releasably secured to the reinforced edge 9, which in the case of the main rod assembly 3 is carried out with the aid of the pockets arranged in the edge 9 for receiving the ends 11 of the rods 5*b* of the secondary rod assembly 4.

Due to the inventive structure of the gazebo 1, the exemplary gazebo 1 can dispense with any center rod that supports the gazebo 1 from the ground or by means of which the gazebo can be assembled by changing the length of the center rod or an assembly mechanism. This allows for very good usability of the interior of the gazebo 1.

Figure 2:
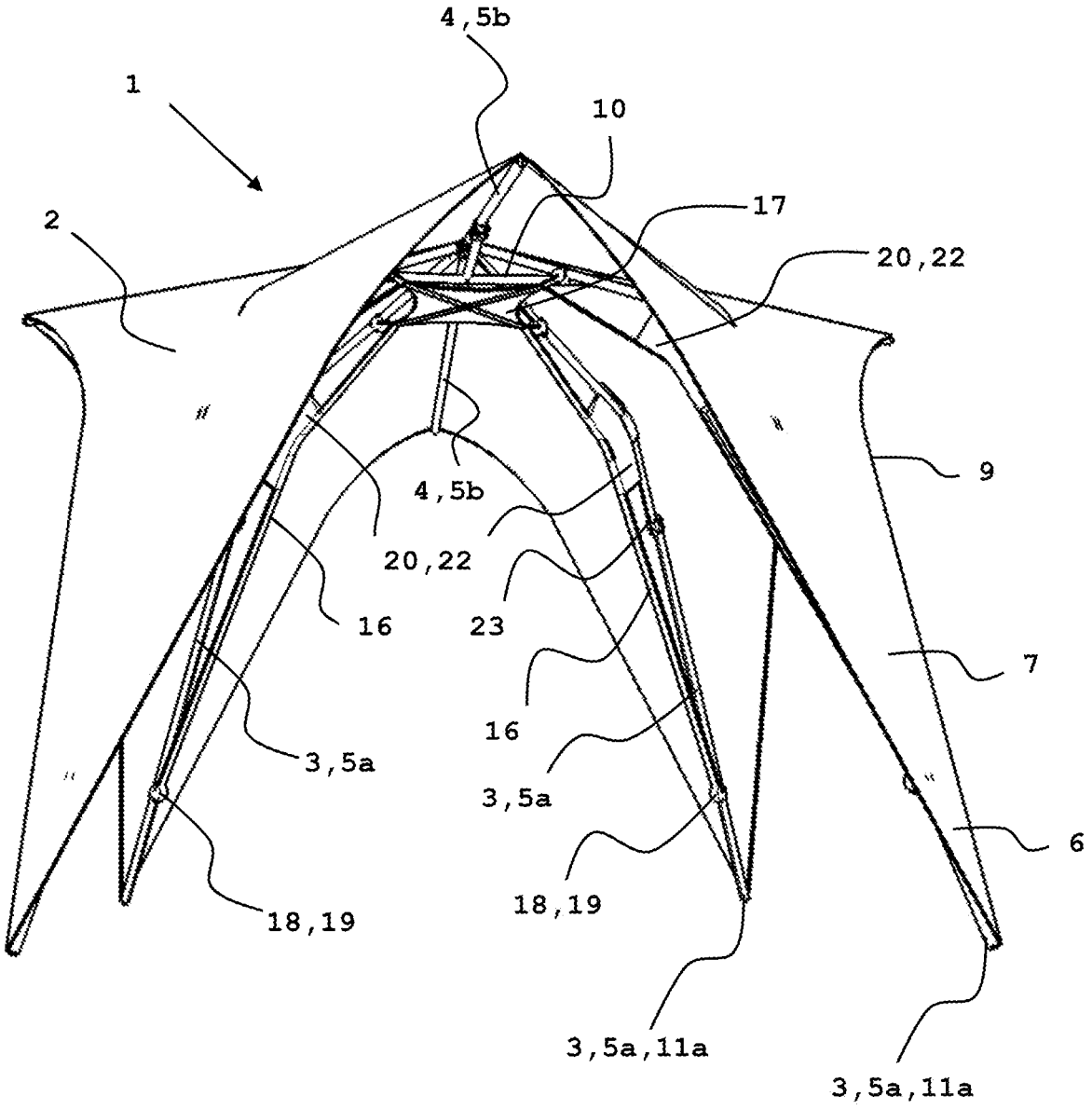
FIG. 2 shows a schematic representation of the gazebo of FIG. 1 in a view obliquely from below.

FIG. 2 shows the gazebo 1 of FIG. 1 in a schematic view, obliquely from below. As a result, the rod assembly 3,4 is visible to a greater extent than in FIG. 1.

The main rod assembly 3 formed of two main rods 5*a*, each extending from an end portion 6 of the gusset 7 of the cover 2 to the opposite end portion 6 and together forming the opposite feet 11*a*. Overall, the gazebo 1 thus has four supporting feet 11*a*.

Each main rod 5*a* is associated with a spacing-limiting strap 16, which by means of a positive connection 19 is connected in the end region near the supporting foot 11*a* with its end 18 to the main rod 5*a* and is arranged on the inside of the rods 5*a*, i.e., on the side of the main rod 5*a* facing away from the cover 2. These straps 16 are substantially made of polyester.

In the roof area of the gazebo 1, the straps 16 merge into a two-dimensional element 17 for connecting the plurality of the spacing-limiting straps 16. With the help of the two-dimensional element 17, the forces between the spacing-limiting straps 16 are compensated. The two-dimensional element 17 is preferably additionally connected to the main rods 5*a* via a positive connection, by means of which the two-dimensional element 17 is arranged in the roof area below the intersection of the main rods 5*a* as well as the secondary rods 5*b*. With the aid of this connection, it is possible to introduce forces from the spacing-limiting straps 16 to the main rods 5*a* in additional regions of the main rods 5*a*.

In a corresponding manner, this is done by means of the two-dimensional webs 20 for connecting the rods 5*a* of the main rod assembly 3 with the spacing-limiting straps 16. These two-dimensional webs 20 are made of the same material as the cover made of coated polyester. The webs 20 have tube-like cavities for receiving the spacing-limiting straps 16 or for receiving the rods 5*a* of the main rod assembly 3 and can thus transmit forces between them. Since the two-dimensional webs 20 are additionally connected to the cover 2, they also provide two-dimensional webs 22 for transmitting forces between the cover 2 and the spacing-limiting straps 16 or the rods 5*a*.

The two-dimensional webs 20,22 are arranged such that they are disposed in the region 24 of the cover 2 on a connecting line between the ends 11 of two adjacent rods 5*b* of the secondary rod assembly 4 and the path of a rod 5*a* of the main rod assembly 3. Preferably, the two-dimensional webs 20,22 are firmly connected with the cover 2 over a length of about 20 cm, which is done in particular by sewing and bonding the polyester fabric of the webs 20,22 and the cover 2.

In addition to the main rod assembly 3, the secondary rod assembly 4 is also formed of resilient rods 5*b*. These secondary rods 5*b* are suitable and intended for connecting respective center regions 8 of the edge 9 between two adjacent gussets 7 of the cover 2.

In the center of the secondary rods 5*b* is a hinge region 12 which hingedly connects the two parts of the rod 5*b*. This hinge region 12 is shown in more detail in FIG. 3. The hinge regions 12 of the secondary rods 5*b* together form a common hinge region 12*a*. Correspondingly, the hinge regions of the rods of the main rod assembly also form a common hinge region. The common hinge regions can even be combined into a single common hinge region.

FIG. 2 shows the tensioning element 10, which is arranged between the two-dimensional element 17 and the common hinge regions 12*a* of the main rod assembly 3 and the secondary rod assembly 4. This is explained in more detail below with reference to FIG. 3.

The rods 5*a* of the main rod assembly 3 are provided with a plurality of swivel joints 23 which have a stop to prevent overextension, which makes it possible to fold the main rods 5*a* by means of the swivel joint 23 without undesirable overextension of the swivel joint 23, which would negatively affect the stability of the main rods 5*a* particularly when assembled. The folding facilitates handling and transport of the main rod assembly 3.

In this case, the length of the rod 5*a* of the main rod assembly 3 and the length of the rod 5*b* of the secondary rod assembly 4 between the swivel joint 23 and the common hinge region 12*a* is selected according to the length between a rod 5*b* of the secondary rod assembly 4 and the common hinge region 12*a*. This allows for a particularly simple and compact folding of the rod assembly 3,4, in particular when all three lengths are selected to be about the same by appropriately positioning the swivel joint 23.

FIG. 3 shows a schematic structure of an exemplary tensioning element 10, which acts exclusively on the rods 5*b* of the secondary rod assembly 4. The two rods 5*b* of the secondary rod assembly 4 intersect in a common hinge region 12*a*. The rods 5*b* are divided into two parts which are hinged together. This takes place via straps 14, which enable the articulated connection 13 of the ends of the parts of the rod 5*b* of the secondary rod assembly 4.

The two straps 14 of the two articulated connections 13 of the two secondary rods 5*b* have a common, two-dimensional element 15. This common, two-dimensional element 15 is formed by sewing the overlapping straps 14 and is thus capable of compensating for forces between the straps 14 and thus between the rods 5*b* of the secondary rod assembly 4. The region of the straps 14 forms the common hinge region 12*a*. Via these straps 14 of the articulated connections 13, tensile forces, but no compressive forces, can be transmitted, which is not necessary according to the invention since due to the tensioning element 10 and the spreading produced by this, no or almost no compressive forces between the parts of the rods 5*b* need to be transmitted. These joints have a simple and robust structure.

The tensioning element 10 shown here formed of a connecting rod 10*b*, which is provided with a folding mechanism 10*a*, and two side rods 10*c*, which are fastened centrally to the connecting rod 10*b* and spread out laterally therefrom. The free ends of the connecting rod 10*b* and the side rods 10*c* are pivotally connected to the four parts of the secondary rods 5*b*, whereby a pivoting of the rods 5*b*, 10*b*, 10*c* against each other about a rotational axis without moving the articulated connection along the rods 5*b*, 10*b*, 10*c* is made possible. This is made possible by means of receptacles fastened to the rods 5*b*, with rotary bearings designed as bores into which bolts in the manner of a hinged connection arranged at the ends of the connecting rod 10*b* or the side rod 10*c* engage.

The connecting rod 10*b* of the tensioning element 10 can be varied in length by means of the folding mechanism 10*a*, which has a toggle lever mechanism. With the help of the toggle mechanism of the folding mechanism 10*a*, it is possible in a simple way to increase the length of the connecting rod 10*b* of the tensioning element 10 without requiring large forces, even if this is done against serious counterforces through the rest of the gazebo 1, and to thereby unfold the gazebo 1 and to hold it in its opened form.

By extending the connecting rod 10*b*, the spacing between the receptacles of the articulated connections on the secondary rods 5*b* is increased and thereby, the secondary rods 5*b* with their ends 11 are also spread apart, thus increasing their relative spacing. If this movement is limited by opposing forces, for example by tensioning forces of the cover 2 or by the main rod assembly 3 with the associated straps 16, an equilibrium of forces is formed which defines the static structure of the gazebo 1 according to the invention in the assembled state.

The gazebo 1 according to the invention is characterized by easy handling and secure footing even without additional anchors in the ground. The fact that it does not need a center rod nor a floor or bracing on the ground proves a very simple structure and at the same time a high utility value, which is characterized in particular by large freedom of movement, good head room and easy handling. Furthermore, the gazebo 1 according to the invention proves to be mobile and therefore easily movable in its assembled state from one location to another. It is largely independent of the ground.

According to the invention, the assembled gazebo 1 is characterized by a simple disassembly process. First, the connecting rod 10*b* of the tensioning element 10 is shortened by means of the folding mechanism 10*a* by operating the toggle mechanism. By shortening said rod, the spacings of the rods 5*b* of the secondary rod assembly 4 and thus also the spacings of the rods 5*a* of the main rod assembly 3 connected with the latter via the cover 2 and its edge 9 decrease, resulting in a collapsing or folding of the gazebo 1 with the cover 2 and the rod assembly 3,4. It is possible to disconnect the connecting rod 10*b* from the secondary rod 5*b* after releasing on one side and to thereby unlock the tensioning element 10. As a result, the tensioning element 10 can be freely pivoted about the locked swivel joint 23 and thereby, the parts of the main rods 5*a* and of the secondary rods 5*b* in the common hinge region 12*a* can be folded. Thereafter, the swivel joints 23 of the main rods 5*a* of the main rod assembly 3 are used to collapse the two legs of the sections of the main rods 5*a*, whereby the gazebo 1 is folded even more compact.

In order to assemble the gazebo 1, in reverse order, the main rods 5*a* at the swivel joints 23 are first moved to the straight, unfolded position, i.e., extended up to the stop, to then hang the connecting rod 10*b* into the receptacle on the secondary rod 5*b* and extend the connecting rod 10*b* of the tensioning element 10 by operating the folding mechanism 10*a* such, that the gazebo 1 according to the invention has assumed a stable structure. Finally, the gazebo 1 is placed on its supporting four feet in the desired location.

Figure 4:
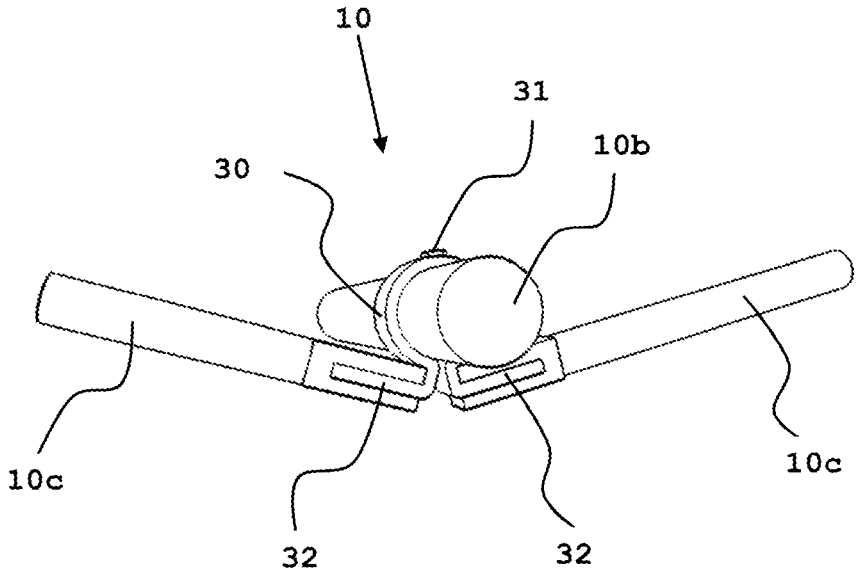
FIG. 4 shows an exemplary articulated connection of the side rods with the connecting rods of a tensioning element.

FIG. 4 illustrates a partial view of the tensioning element 10. The tensioning element 10 is designed such that it is provided with two side rods 10*c*, which are arranged in pairs on both sides of said connecting rod 10*b* and are both hingedly connected via the connecting rod 10*b*. The articulated connection takes place by means of a strap 30 of high-tensile fabric. The ends 32 of the strap 30 are firmly but releasably connected with the ends of the side rods 10*c* facing the connecting rod. The strap 30 is centrally connected with the connecting rod 10*b* via a fixing screw 31.

The connection of the strap 30 with the connecting rod 10*b* takes place in such a way that the strap 30 is firmly connected to the connecting rod 10*b* and thereby, a movement of the connecting rod 10*b* for opening up the gazebo 1 via the fixed strap 30 can be transmitted to the side rods 10*c*. This creates the possibility of transmitting forces from the tensioning element 10 via the connecting rod 10*b* to the side rods 10*c* and thus to the cover 2.

This makes it possible for the tensioning forces to be distributed by the tensioning element 10 to the cover 2 and thereby, the opening up of the gazebo 1 according to the invention is made possible in a particularly reliable and easy manner.

In this case, the strap 30 engages around the connecting rod 10*b* in such a way that on one side of the connecting rod 10*b*, the fixing screw 31 is mounted and on the opposite side of the connecting rod 10*b*, the two ends 32 of the side rods 10*c* come to rest, which are firmly connected with the ends 32 of the strap 30. As a result of this design of the articulated connection with the strap 30 surrounding the connecting rod 10*b*, it is possible for the tensioning forces, which are transmitted via a side rod 10*c*, to lead to a rotational movement of the connecting rod 10*b*, which is compensated by a counter rotation by means of the tensioning forces, which are transmitted via the other side rod 10*c*. This is made particularly possible by guiding the strap 30 about the connecting rod 10*b* and by fixing the strap 30 to the connecting rod 10*b*. By a distinct strap width, it is possible that lateral forces can also be transmitted to the edge portion 6,8,9 of the cover 2 via the side rods 10*c*, said cover being connected with the ends 11 of the rods 5*a*, 5*b*, which in turn are connected with the side rods 10*c*. This design also makes it possible for the side rods 10*c* to lay laterally against the connecting rod 10*b* when the gazebo 1 is folded and thus are easily transported.

This design of the tensioning element 10 allows for a simple construction of the gazebo 1 and a good handling of the gazebo 1.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A gazebo or tent comprising:

a two-dimensional cover;

a rod assembly, which is connected to the cover and holds the cover in a three-dimensional shape, the rod assembly comprising a main rod assembly and a secondary rod assembly, the main rod assembly having one or more resilient rods to connect opposite end portions of at least two gussets of the cover with each other and to form supporting feet for the gazebo or the tent at the opposite end portions, the secondary rod assembly having one or more resilient rods to connect center regions of edges between two adjacent gussets of the at least two gussets of the cover with each other; and at least one tensioning element distinct from the main rod assembly and the secondary rod assembly, the at least one tensioning element increasing a spacing between the opposite end portions of the at least two gussets and ends of the one or more resilient rods of the main rod assembly, the tensioning element contacting the one or more resilient rods of the main rod assembly, wherein no center rod is provided, and wherein at least one additional rod is provided for the main rod assembly and/or for the secondary rod assembly, which extends as part of the main rod assembly from an end portion of a gusset and/or as part of the secondary rod assembly from a center region to a common hinge region and is hingedly connected there with other rods.

2. The gazebo or tent according to claim 1, wherein the one or more resilient rods of the main rod assembly and/or the secondary rod assembly are made of several parts, wherein parts of the one or more resilient rods are hingedly connected with each other in a hinge region and several sections of several rods of the one or more resilient rods are hingedly connected in a common hinge region.

3. The gazebo or tent according to claim 1, wherein an articulated connection between the one or more resilient rods or between parts of rods is formed by straps, wires, ropes, springs, rubber-elastic connecting elements and/or swivel joints, wherein the connecting elements and/or swivel joints of the articulated connection are distinct from the main rod assembly and the secondary rod assembly.

4. The gazebo or tent according to claim 1, wherein:

at least one two-dimensional web for receiving a rod and a strap or an articulated connection designed as a wire or as a rope or as a spring or as a rubber-elastic connecting element is provided, or a web for transmitting tension between a rod and a received strap or an articulated connection designed as a wire or rope or spring or rubber-elastic connecting element is provided.

5. The gazebo or tent according to claim 4, wherein at least one web is arranged in the region of a connecting line between the ends of two adjacent rods of the secondary rod assembly at the edge of the cover.

6. The gazebo or tent according to claim 1, wherein the cover is selected and arranged such that in a region of a rod of the one or more resilient rods, the cover along the rod is not formed so as to be stretchable, while the cover is formed resiliently stretchable in other directions.

7. The gazebo or tent according to claim 1, wherein the at least one tensioning element comprises a folding mechanism and/or a spreading element and/or a cable pull for generating the spacing variation and/or a piston which is driven pneumatically or hydraulically or electrically or mechanically using a slip clutch.

8. The gazebo or tent according to claim 1, wherein the at least one tensioning element is formed such that it is arranged as a connecting rod between two areas of one or two rods of the one or more resilient rods of the secondary rod assembly, in such a way that by varying the length of the connecting rod, the spacing between the ends of the one or two rods of the rod assembly connected with the connecting rod and thus the spacing between areas of the cover connected with the ends of the one or two rods is adjustable.

9. The gazebo or tent according to claim 1, wherein the cover is provided with at least one two-dimensional web for receiving one or more rods and/or one or more straps and/or one or more articulated connections, which is provided for the transmission of tension of a received rod or a received strap to the cover.

10. The gazebo or tent according to claim 1, wherein rods of the main rod assembly are provided with swivel joints which comprise a stop for preventing hyperextension, wherein a length of the rods of the main rod assembly or the secondary rod assembly between a swivel joint and the common hinge region are at least partially selected based on a length between a rod of the secondary rod assembly and the common hinge region.

11. The gazebo or tent according to claim 1, wherein the edge region of the cover is formed in a reinforced manner and is formed to be of high-tensile strength, wherein the cover is disposed over an outer periphery of the main rod assembly and the secondary rod assembly.

12. The gazebo or tent according to claim 1, wherein at least one rod of the secondary rod assembly is or are formed to be more resistant to bending than at least one rod or all rods of the main rod assembly.

13. The gazebo or tent according to claim 1, wherein at least one rod of the secondary rod assembly and/or of the main rod assembly is designed such that it is formed to be more resistant to bending in the area of at least one of its ends than in its center region or in a common hinge region.

14. A gazebo or tent comprising:

a two-dimensional cover;

a rod assembly, which is connected to the cover and holds the cover in a three-dimensional shape, the rod assembly comprising a main rod assembly and a secondary rod assembly, the main rod assembly having one or more resilient rods to connect opposite end portions of at least two gussets of the cover with each other and to form supporting feet for the gazebo or the tent at the opposite end portions, the secondary rod assembly having one or more resilient rods to connect center regions of edges between two adjacent gussets of the at least two gussets of the cover with each other; and at least one tensioning element distinct from the main rod assembly and the secondary rod assembly, the at least one tensioning element increasing a spacing between the opposite end portions of the at least two gussets and ends of the one or more resilient rods of the main rod assembly, the tensioning element contacting the one or more resilient rods of the main rod assembly, wherein no center rod is provided, wherein the one or more resilient rods of the main rod assembly and/or the secondary rod assembly are made of several parts, wherein parts of the one or more resilient rods are hingedly connected with each other in a hinge region and several sections of several rods of the one or more resilient rods are hingedly connected in a common hinge region, and wherein a two-dimensional element is provided in the common hinge region, which connects a plurality of straps, wires, ropes, springs, and/or rubber-elastic connecting elements of an articulated connection in the common hinge region and compensates for introduced tensions.

15. A gazebo or tent comprising:

a two-dimensional cover; and a rod assembly, which is connected to the cover to hold the cover in a three-dimensional shape, the rod assembly comprising a main rod assembly and a secondary rod assembly, the main rod assembly having one or more resilient rods to connect end portions of two opposite gussets of the cover with each other and to form supporting feet for the gazebo or the tent, the secondary rod assembly having one or more resilient rods to connect center regions of edges between two adjacent gussets of the cover with each other; and at least one tensioning element to at least increase a spacing between ends of a rod of the rod assembly and thus a spacing between the areas of the cover connected with the end of the rod, wherein no center rod is provided, wherein at least a strap or a rope is provided between different sections of a rod and/or a part of a rod and is suitable for limiting the different sections in terms of spacing.

16. The gazebo or tent according to claim 15, wherein at least one two-dimensional element is provided, which connects a plurality of straps or ropes extending between different areas of a rod and/or a section of a rod of the one or more resilient rods, in an area of a common hinge region, and compensates for introduced stresses.

17. A gazebo or tent comprising:

a two-dimensional cover; and a rod assembly, which is connected to the cover and holds the cover in a three-dimensional shape, the rod assembly comprising a main rod assembly and a secondary rod assembly, the main rod assembly having one or more resilient rods to connect opposite end portions of at least two gussets of the cover with each other and to form supporting feet for the gazebo or the tent at the opposite end portions, the secondary rod assembly having one or more resilient rods to connect center regions of edges between two adjacent gussets of the at least two gussets of the cover with each other; and at least one tensioning element distinct from the main rod assembly and the secondary rod assembly, the at least one tensioning element increasing a spacing between the opposite end portions of the at least two gussets and ends of the one or more resilient rods of the main rod assembly, the tensioning element contacting the one or more resilient rods of the main rod assembly, wherein no center rod is provided, wherein the at least one tensioning element is formed such that it is provided with at least one side rod, which connects the connecting rod with a further rod of the secondary rod assembly, and transmits forces when changing the length of the connecting rod to the further rod and thus to the cover.

18. The gazebo or tent according to claim 17, wherein the at least one tensioning element is formed with at least two side rods, at least two of the at least two side rods are arranged in pairs on both sides of the connecting rod and both of which are hinged together via the connecting rod or connected by means of a strap.

19. A gazebo or tent comprising:

a two-dimensional cover;

a rod assembly, which is connected to the cover and holds the cover in a three-dimensional shape, the rod assembly comprising a main rod assembly and a secondary rod assembly, the main rod assembly having one or more resilient rods to connect opposite end portions of at least two gussets of the cover with each other and to form supporting feet for the gazebo or the tent at the opposite end portions, the secondary rod assembly having one or more resilient rods to connect center regions of edges between two adjacent gussets of the at least two gussets of the cover with each other; and at least one tensioning element distinct from the main rod assembly and the secondary rod assembly, the at least one tensioning element increasing a spacing between the opposite end portions of the at least two gussets and ends of the one or more resilient rods of the main rod assembly, the tensioning element contacting the one or more resilient rods of the main rod assembly, wherein no center rod is provided, and wherein a release for each tensioning element of the at least one tensioning element is provided, which enables the release and connection of the connection between rod and tensioning element and wherein a guide element is provided, which is provided for guiding the released tensioning element along a rod to be connected.

* * * * *